US010510522B2

(12) United States Patent
Sugiyama et al.

(10) Patent No.: US 10,510,522 B2
(45) Date of Patent: Dec. 17, 2019

(54) MASS SPECTROMETRY USING PLASMA ION SOURCE

(71) Applicant: Agilent Technologies, Inc., Santa Clara, CA (US)

(72) Inventors: Naoki Sugiyama, Tokyo (JP); Mineko Omori, Hachioji (JP); Kazumi Nakano, Hachioji (JP)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 16/219,414

(22) Filed: Dec. 13, 2018

(65) Prior Publication Data

US 2019/0214239 A1 Jul. 11, 2019

(30) Foreign Application Priority Data

Dec. 15, 2017 (JP) ..... 2017-240258

(51) Int. Cl.

| | |
|---|---|
| ***H01J 49/00*** | (2006.01) |
| ***H01J 49/10*** | (2006.01) |
| ***H01J 49/12*** | (2006.01) |
| ***H01J 49/42*** | (2006.01) |

(52) U.S. Cl.

CPC ..... *H01J 49/0036* (2013.01); *H01J 49/105* (2013.01); *H01J 49/12* (2013.01); *H01J 49/4215* (2013.01)

(58) Field of Classification Search

CPC .. H01J 49/0036; H01J 49/4215; H01J 49/105; H01J 49/12

USPC ..... 250/281, 282, 288

See application file for complete search history.

(56) References Cited

U.S. PATENT DOCUMENTS

2015/0187556 A1* 7/2015 Shimura ..... H01J 49/105 250/282

OTHER PUBLICATIONS

Nagao, Keisuke. "Fundamentals of Mass Spectrometry—Isotope Ratio Mass Spectrometry." J. Mass Spectrom. Soc. Jpn. vol. 59, No. 2, 2011.

Nakano, Kazumi et al. "Study of a novel interference correction method for doubly-charged ions to improve trace analysis of As and Se in environmental samples by ICP-MS." European Winter Conference on Plasma Spectrochemistry, Munster, Germany, Feb. 23, 2015 FU2-PO07.

* cited by examiner

*Primary Examiner* — Michael Maskell

(57) ABSTRACT

To correct spectral interference due to a divalent ion of an interfering element on a measurement ion of an analysis element measured by a mass spectrometer using a plasma ion source by accounting for a mass-bias effect of the mass spectrometer, measurement values of ionic strength of divalent ions of two isotopes having different, odd mass numbers among isotopes of the interfering element are used. In measuring to obtain a measurement value where a correction method of the present invention is applied, it is suitable to set a mass resolution of the mass spectrometer to be higher than a time of normal analysis.

10 Claims, 7 Drawing Sheets

| Mass no. (m) | Nd | Sm | Eu | Gd | Tb | Dy | Ho | Er | m/2 |
|---|---|---|---|---|---|---|---|---|---|
| 142 | 27.2 | | | | | | | | 71 |
| 143 | 12.2 | | | | | | | | 71.5 |
| 144 | 23.8 | 3.07 | | | | | | | 72 |
| 145 | 8.3 | | | | | | | | 72.5 |
| 146 | 17.2 | | | | | | | | 73 |
| 147 | | 14.99 | | | | | | | 73.5 |
| 148 | 5.7 | 11.24 | | | | | | | 74 |
| 149 | | 13.82 | | | | | | | 74.5 |
| *150* | *5.6* | *7.38* | | | | | | | *75* |
| 151 | | | 47.81 | | | | | | 75.5 |
| 152 | | 26.75 | | 0.2 | | | | | 76 |
| 153 | | | 52.19 | | | | | | 76.5 |
| 154 | | 22.75 | | 2.18 | | | | | 77 |
| 155 | | | | 14.8 | | | | | 77.5 |
| *156* | | | | *20.47* | | *0.06* | | | *78* |
| 157 | | | | 15.65 | | | | | 78.5 |
| 158 | | | | 24.84 | | 0.09 | | | 79 |
| 159 | | | | | 100 | | | | 79.5 |
| *160* | | | | *21.86* | | *2.33* | | | *80* |
| 161 | | | | | | 18.89 | | | 80.5 |
| 162 | | | | | | 25.47 | | 0.14 | 81 |
| 163 | | | | | | 24.9 | | | 81.5 |
| *164* | | | | | | *28.26* | | *1.6* | *82* |
| 165 | | | | | | | 100 | | 82.5 |
| 166 | | | | | | | | 33.5 | 83 |
| 167 | | | | | | | | 22.87 | 83.5 |
| 168 | | | | | | | | 26.98 | 84 |
| 169 | | | | | | | | | 84.5 |
| 170 | | | | | | | | 14.91 | 85 |

| Mass no. (m) | Nd | Sm | Eu | Gd | Tb | Dy | Ho | Er | m/2 |
|---|---|---|---|---|---|---|---|---|---|
| 142 | 27.2 | | | | | | | | 71 |
| 143 | 12.2 | | | | | | | | 71.5 |
| 144 | 23.8 | 3.07 | | | | | | | 72 |
| 145 | 8.3 | | | | | | | | 72.5 |
| 146 | 17.2 | | | | | | | | 73 |
| 147 | | 14.99 | | | | | | | 73.5 |
| 148 | 5.7 | 11.24 | | | | | | | 74 |
| 149 | | 13.82 | | | | | | | 74.5 |
| *150* | *5.6* | *7.38* | | | | | | | *75* |
| 151 | | | 47.81 | | | | | | 75.5 |
| 152 | | 26.75 | | 0.2 | | | | | 76 |
| 153 | | | 52.19 | | | | | | 76.5 |
| 154 | | 22.75 | | 2.18 | | | | | 77 |
| 155 | | | | 14.8 | | | | | 77.5 |
| *156* | | | | *20.47* | | *0.06* | | | *78* |
| 157 | | | | 15.65 | | | | | 78.5 |
| 158 | | | | 24.84 | | 0.09 | | | 79 |
| 159 | | | | | 100 | | | | 79.5 |
| *160* | | | | *21.86* | | *2.33* | | | *80* |
| 161 | | | | | | 18.89 | | | 80.5 |
| 162 | | | | | | 25.47 | | 0.14 | 81 |
| 163 | | | | | | 24.9 | | | 81.5 |
| *164* | | | | | | *28.26* | | *1.6* | *82* |
| 165 | | | | | | | 100 | | 82.5 |
| 166 | | | | | | | | 33.5 | 83 |
| 167 | | | | | | | | 22.87 | 83.5 |
| 168 | | | | | | | | 26.98 | 84 |
| 169 | | | | | | | | | 84.5 |
| 170 | | | | | | | | 14.91 | 85 |

FIG. 1

| Mass-to-charge ratio | Nd isotope abundance ratio | Signal value (cps) 1ppm Nd $H_2$ | He |
|---|---|---|---|
| 71 | 27.2 | 30857 | 110945 |
| *71.5* | *12.2* | *14218* | *51156* |
| 72 | 23.8 | 29003 | 102124 |
| *72.5* | *8.3* | *10442* | *36898* |
| 73 | 17.2 | 22660 | 78177 |
| 73.5 | | 0 | 18 |
| 74 | 5.7 | 7711 | 27150 |
| 74.5 | | 0 | 15 |
| *75* | *5.6* | *8127* | *28143* |

| | | | |
|---|---|---|---|
| Mi | M1 | 71.5 | 71.5 |
| | M2 | 72.5 | 72.5 |
| | M3 | 75 | 75 |
| Ai | A1 | 12.2 | 12.2 |
| | A2 | 8.3 | 8.3 |
| | A3 | 5.6 | 5.6 |
| ΔMij | ΔM21 | 1 | 1 |
| | ΔM32 | 2.5 | 2.5 |
| Ci | C1 | 14218 | 51156 |
| | C2 | 10442 | 36898 |
| | A3/A2 | 0.675 | 0.675 |
| | MB | 1.199 | 1.150 |
| cps at mass-to-charge ratio of 75 | No correction | 8127 | 28143 |
| | Conventional correction | 1082 | 3248 |
| | Correction by present invention | −318 | −498 |

FIG. 4

As spike recovery rate (%)

| | | 9 ppb spike, 1 ppm REE | |
|---|---|---|---|
| | | First time | Second time |
| No correction | $H_2$ | 292 | 298 |
| | He | 475 | 473 |
| Conventional correction | $H_2$ | 118 | 122 |
| | He | 136 | 130 |
| Correction by present invention | $H_2$ | *95* | *99* |
| | He | *100* | *93* |

FIG. 6

MASS SPECTROMETRY USING PLASMA ION SOURCE

RELATED APPLICATIONS

This application claims the benefit under 35 U.S.C. 119 of Japanese Patent Application No. JP 2017-240258, filed Dec. 15, 2017, titled "MASS SPECTROMETRY USING PLASMA ION SOURCE," the content of which is incorporated by reference herein in its entirety.

TECHNICAL FIELD

The present invention relates to mass spectrometry using a plasma ion source and particularly relates to a method of correcting spectral interference due to a divalent ion of another element on an ion of an isotope of an element to be analyzed.

BACKGROUND

Operations Overview of Existing Mass Spectrometer Using Plasma Ion Source

Known as one example of a mass spectrometer using a plasma ion source is an inductively coupled plasma mass spectrometer (ICP-MS) using inductively coupled plasma (ICP) as an ion source for ionizing an element in a measurement sample. Operations of such a known inductively coupled plasma mass spectrometer are summarized with reference to FIG. 7, which is a block diagram thereof. In FIG. 7, an optional autosampler 10 or a sample suction tube connected by an operator to a sample introduction unit 15 is wetted in a measurement sample 5 in a sample bottle and the sample 5 is introduced from the sample introduction unit 15 into an ionization unit 20 such that an element included in the sample 5 is ionized by plasma generated in the ionization unit 20. The ionized element is sampled at an interface unit 25 configuring a differential exhaust system including a sampling cone and a skimmer cone; introduced into a high-vacuum chamber having an ion-lens unit 30, a mass separator 35, and a detector 42 therein; converged by the ion-lens unit 30; and afterward injected into the mass separator 35, which is for transmitting only ions of a selected mass-to-charge ratio and is typically configured from a quadrupole mass filter.

The detector 42 is typically configured from a secondary-electron multiplier and outputs an electrical signal corresponding to a number of ions of the mass-to-charge ratio separated by the mass separator 35 that reaches the detector 42 per unit time. The electrical signal output from the secondary-electron multiplier is sent to a pulse counter 44 and an analog current measurement unit 46, and a pulse-count value according to a pulse frequency of the electrical signal and an analog current value of the electrical signal are respectively measured by the pulse counter 44 and the analog current measurement unit 46. The detector 42, the pulse counter 44, and the analog current measurement unit 46 configure an ion measurement unit 40.

An ion-lens voltage drive unit 55 operates so as to apply a voltage to an ion lens in the ion-lens unit 30. The ion lens is configured from an electrostatic-lens group having an action of changing a trajectory of an ion using an electrical field and is configured such that when a voltage applied to an electrode thereof changes, an ion transmission rate changes accordingly. Because of this, by controlling the ion-lens voltage drive unit 55 by a system control unit 60 in order to change the voltage applied to the electrode of the ion lens as appropriate, the ion transmission rate of the ion lens can be increased or decreased. At a time of normal measurement, the voltage applied to the ion lens is set to a predetermined voltage so a transmission rate of an ion of an isotope of an analysis element whose ionic strength is to be measured is maximized in order to determine a concentration of the analysis element in the measurement sample.

The system control unit 60 controls operations of each block in FIG. 7, and a computational processing unit 65 performs data processing such as converting the measured analog current value into an ion count per second (cps) for each mass-to-charge ratio (m/z). Note that it is also possible to connect the mass spectrometer and an external computing device 70 such as a PC (personal computer) via a network or the like to transfer data such as a measurement value of ionic strength (ion count) to the computing device 70 and perform computational processing seeking the ionic strength of the ion of the isotope of the analysis element to be measured and input/output processing with a user.

By making polarities identical for two opposing rod electrodes among four parallel rod electrodes configuring a quadrupole mass filter of the mass separator 35 (a polarity of one pair of opposing rod electrode being opposite a polarity of the other pair of rod electrodes) to apply a voltage where a DC voltage and a high-frequency AC voltage are superimposed and setting the voltage of the DC voltage and the voltage of the high-frequency AC voltage as appropriate, only ions of a specified mass-to-charge ratio can be transmitted to reach the detector 42. Moreover, by changing a ratio between the DC voltage and the high-frequency AC voltage applied to these rod electrodes, a mass resolution can be adjusted. Note that this setting of the mass-to-charge ratio and the mass resolution is performed by the system control unit 60 in response to an input setting desired by the operator via the external computing device (70 in FIG. 7) of the mass spectrometer. Moreover, there are mass spectrometers using a plasma ion source that use a sector mass filter, and these devices can adjust the mass resolution by changing a slit width through which the ions pass.

As another example of a mass spectrometer using a plasma ion source, there is a glow-discharge mass spectrometer (GDMS), which uses a glow discharge as a means of ionization.

By measuring the ionic strength of the ion of the isotope of the analysis element by a mass spectrometer using a plasma ion source such as above, the concentration of the analysis element can be determined. Hereinbelow, in the present specification, the ion of the isotope of the analysis element whose ionic strength is to be measured in order to determine this concentration is referred to as a "measurement ion of the analysis element" and the isotope thereof is referred to as a "measurement isotope of the analysis element" (in a situation where a certain specific analysis element is defined as a, these are respectively referred to as a "measurement ion of analysis element $\alpha$" and a "measurement isotope of analysis element $\alpha$").

Conventional Method of Correcting Spectral Interference

When measuring a concentration whereat an analysis element such as arsenic (As) or selenium (Se) is included in a measurement sample such as an environmental or food sample by a mass spectrometer using a plasma ion source such as an ICP-MS (in a situation where the present specification simply refers to a "mass spectrometer," this signifies a mass spectrometer using a plasma ion source), in a situation where a rare-earth element is included in the sample, a measurement error due to spectral interference may arise in a measurement value of ionic strength of a measurement ion of the analysis element. This spectral interference arises due to a mass-to-charge ratio of the measurement ion of the analysis element and a mass-to-charge ratio of a divalent ion of the rare-earth element in the sample being identical or close such that separation by the mass spectrometer is not possible.

FIG. 1 lists isotope mass numbers (m), isotope abundance ratios, and mass-to-charge ratios of divalent ions (m/2) for each of several rare-earth elements. For example, the mass-to-charge ratio of divalent ion $^{150}Nd^{2+}$ of $^{150}Nd$ (neodymium), a rare-earth element, and the mass-to-charge ratio of divalent ion $^{150}Sm^{2+}$ of $^{150}Sm$ (samarium), which is also a rare-earth element, are both 75, which is identical to the mass number of $^{75}As$ (although strictly speaking there is a difference, this difference is small, and separation by a mass spectrometer is not possible). Because of this, in a situation where the analysis element in the sample is As and the measurement ion of analysis element As is a $^{75}As$ ion of a mass-to-charge ratio of 75, if these rare-earth elements are present in the sample, divalent ions thereof cause spectral interference for the $^{75}As$ ion of the mass-to-charge ratio of 75, preventing the concentration of As in the sample from being accurately determined. Similarly, in a situation where the analysis element in the sample is Se and the measurement ion of analysis element Se is a $^{78}Se$ ion of a mass-to-charge ratio of 78, divalent ion $^{156}Gd^{2+}$ of rare-earth element $^{156}Gd$ (gadolinium) and divalent ion $^{156}Dy^{2+}$ of rare-earth element $^{156}Dy$ (dysprosium) cause spectral interference for the $^{78}Se$ ion of the mass-to-charge ratio of 78.

Hereinbelow, in the present specification, elements such as $^{150}Nd$ and $^{150}Sm$ above that, when ionized, cause spectral interference for a measurement ion of an analysis element are referred to as interfering elements. Known as a conventional correction method of correcting such spectral interference due to a divalent ion of an interfering element present in a sample is one using a measurement value of ionic strength of a divalent ion of an isotope having an odd mass number among isotopes of the interfering element (non-patent literature 1). This conventional correction method is described below.

An analysis element in a sample is defined as a, and a mass number of a measurement isotope of analysis element $\alpha$ is defined as $\alpha_n$. Here, when analysis element $\alpha$ is ionized, it becomes a monovalent ion. As such, the mass number $\alpha_n$ of the measurement isotope of analysis element $\alpha$ and a mass-to-charge ratio of a measurement ion of analysis element $\alpha$ are equal. Therefore, hereinbelow, $\alpha_n$ is also used to represent the mass-to-charge ratio of the measurement ion of analysis element $\alpha$. A certain interfering element present in the sample is defined as X, and respective divalent ions of X1 and X2, two different isotopes of X (respective mass numbers being $X1_n$ and $X2_n$), are defined as $X1^{2+}$ and $X2^{2+}$. Here, $X2_n$ is odd (a signal of a divalent ion of an isotope of an odd mass number can be accurately measured without interference because a mass-to-charge ratio thereof is not an integer). $X1^{2+}$ causes spectral interference for the measurement ion of analysis element $\alpha$ because a mass-to-charge ratio thereof ($X1_n/2$) is identical to the mass-to-charge ratio $\alpha_n$ of the measurement ion of analysis element $\alpha$ or so close to an that separation is not possible at a resolution of the mass spectrometer.

A measurement value of ionic strength at the mass-to-charge ratio $\alpha_n$ measured by the mass spectrometer and a measurement value of ionic strength at a mass-to-charge ratio $X2_n/2$ are respectively defined as $[\alpha_n]m$ and $[X2_n/2]m$. $[X2_n/2]m$ is multiplied by an isotope ratio A1/A2, which is a ratio between a theoretical isotope abundance ratio A1 of X1 and a theoretical isotope abundance ratio A2 of X2, and this subtracted from $[\alpha_n]m$ is defined as corrected value $[\alpha_n]c$, where spectral interference due to $X1^{2+}$ is corrected. That is, $$[\alpha_n]c=[\alpha_n]m-[X2_n/2]m\times A1/A2. \quad \text{[Formula 1-1]}$$

An example is described where, in a situation where As as the analysis element and Nd and Sm as the interfering elements are copresent in the sample, the conventional method above is applied to correct spectral interference due to divalent ions thereof on a $^{75}As$ ion of a mass-to-charge ratio of 75 that is the measurement ion of the analysis element As. In this situation, as above, $^{150}Nd^{2+}$ and $^{150}Sm^{2+}$ cause spectral interference for the $^{75}As$ ion whose mass-to-charge ratio is 75.

First, correction of the spectral interference due to $^{150}Nd^{2+}$ is described. Respectively defining a measurement value of ionic strength at a mass-to-charge ratio of 75 as measured by the mass spectrometer and a measurement value of ionic strength at a mass-to-charge ratio of 72.5 as measured by the mass spectrometer (that is, a measurement value of ionic strength of $^{145}Nd^{2+}$) as [75]m and [72.5]m, $[\alpha_n]m$ and $[X2_n/2]m$ in [formula 1-1] respectively correspond to [75]m and [72.5]m. Moreover, an isotope ratio of $^{150}Nd$ and $^{145}Nd$ is known to be $^{150}Nd/^{145}Nd=5.6/8.3\approx0.675$) (see FIG. 1), and this corresponds to A1/A2 in [formula 1-1]. That is, defining an ionic strength at the mass-to-charge ratio of 75 where the spectral interference due to $^{150}Nd^{2+}$ is corrected as [75]c, in the present example, [formula 1-1] is expressed as $$[75]c=[75]m-[72.5]m\times5.6/8.3. \quad \text{[Formula 1-2]}$$

The spectral interference due to $^{150}Sm^{2+}$ on the $^{75}As$ ion of the mass-to-charge ratio of 75 is corrected in a similar manner. That is, by multiplying a measurement value of ionic strength at a mass-to-charge ratio of 73.5 (that is, a measurement value of ionic strength of $^{147}Sm^{2+}$) with $^{150}Sm/^{147}Sm$, which is the isotope ratio of $^{150}Sm$ and $^{147}Sm$, and subtracting this from the [75]c in [formula 1-2], an ionic strength is obtained where the spectral interference due to both $^{150}Nd^{2+}$ and $^{150}Sm^{2+}$ on the $^{75}As$ ion of the mass-to-charge ratio of 75 is corrected.

Non-Patent Literature

Non-Patent Literature 1: Kazumi NAKANO et al., "Study of a novel interference correction method for doubly-charged ions to improve trace analysis of As and Se in environmental samples by ICP-MS," European Winter Conference on Plasma Spectrochemistry, Munster, Germany, Feb. 23, 2015.

Non-Patent Literature 2: Keisuke Nagao, "Fundamentals of Mass Spectrometry: Isotope Ratio Mass Spectrometry-," *J. Mass Spectrom. Soc. Jpn. Vol.* 59, no. 2 (2011): 46.

Technical Problem

Because the conventional correction method above can be carried out by implementing software for executing the correction method in an existing computing resource inside or outside the mass spectrometer, the method is effective in that spectral interference can be corrected simply and at a low cost without providing a special mechanism to the mass spectrometer. However, this conventional correction method does not account for an influence of a mass-bias effect that is generally seen in mass spectrometers such as inductively coupled plasma mass spectrometers (ICP-MS). The mass-bias effect is caused by a number of ions reaching a detector of a mass spectrometer differing according to a mass-to-charge ratio thereof due to a transport efficiency of the ions in the mass spectrometer differing according to the mass-to-charge ratio of the ions.

FIG. 2 illustrates a relationship between mass-to-charge ratios and transport efficiencies of ions in an existing ICP-MS (mass-to-charge ratio dependency of transport efficiency in an ICP-MS). For example, although a theoretical isotope ratio $^{150}Nd/^{145}Nd$ of $^{150}Nd$ and $^{145}Nd$ is 5.6/8.3 (≈0.675), because the transport efficiencies change according to the mass-to-charge ratios, a value of a ratio of strengths of each isotope that reaches the detector of the mass spectrometer differs from the theoretical isotope ratio $^{150}Nd/^{145}Nd$. Therefore, the conventional correction method above that uses the theoretical isotope ratio as-is as in [formula 1-1] does not account for measurement error caused by the mass-bias effect in the mass spectrometer and therefore does not provide an accurate correction.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

Solution to Problem

To correct spectral interference due to a divalent ion of an interfering element on a measurement ion of an analysis element measured by a mass spectrometer using a plasma ion source by accounting for a mass-bias effect of the mass spectrometer, measurement values of ionic strength of divalent ions of two isotopes having different, odd mass numbers among isotopes of the interfering element are used. Note that in measuring to obtain a measurement value where a correction method of the present invention is applied, measured is not only an ionic strength at a mass-to-charge ratio of an integer value that is measured at a time of normal analysis but also an ionic strength at a mass-to-charge ratio of a non-integer value of (odd number/2). As such, in measuring to obtain the measurement value where the correction method of the present invention is applied, overlap between peaks corresponding to each measurement value of the divalent ions of these isotopes having the odd mass numbers and peaks adjacent to these peaks is decreased or removed and a mass resolution of the mass spectrometer is increased to increase a measurement precision of ionic strength. That is, it is suitable to make a FWHM (full width at half maximum) smaller than at the time of normal analysis.

According to an embodiment, a method of correcting spectral interference due to a divalent ion of an interfering element on a measurement ion of an analysis element in a sample measured by a mass spectrometer using a plasma ion source, where in a situation where at least one type of interfering element having three different isotopes is present in the sample and any two of these isotopes (these two isotopes being respectively referred to as a "first isotope" and a "second isotope" and another one isotope being referred to as a "third isotope") have an odd mass number, comprised are: a step of using, from the at least one type of interfering element, a measurement value of ionic strength of a divalent ion of the first isotope in the sample and a measurement value of ionic strength of a divalent ion of the second isotope in the sample to calculate an interference amount of spectral interference due to a divalent ion of the third isotope on the measurement ion of the analysis element; and a step of subtracting the interference amount calculated for the at least one type of interfering element from a measurement value of ionic strength at a mass-to-charge ratio of the measurement ion of the analysis element in the sample measured by the mass spectrometer to seek a corrected value of ionic strength at the mass-to-charge ratio of the measurement ion of the analysis element.

According to another embodiment, when, for each of the at least one type of interfering element, the measurement value of ionic strength of the divalent ion of the first isotope and the measurement value of ionic strength of the divalent ion of the second isotope are respectively defined as C1 and C2; isotope abundance ratios of the first isotope, the second isotope, and the third isotope are respectively defined as A1, A2, and A3; and mass-to-charge ratios of the divalent ion of the first isotope, the divalent ion of the second isotope, and the divalent ion of the third isotope are respectively defined as M1, M2, and M3, the interference amount of spectral interference due the divalent ion of the third isotope of each of the at least one type of interfering element is calculated as $C2\times(A3/A2)\times[(1+a\times(M3-M2)]$, a here being $[1/(M2-M1)]\times[(C2/C1)/(A2/A1)-1]$.

According to another embodiment, in a situation where a quadrupole mass spectrometer is used as the mass spectrometer, a mass resolution of the mass spectrometer is set to no greater than 0.4 amu (FWHM).

According to another embodiment, the analysis element is As or Se.

According to another embodiment, in a situation where the analysis element is As, the at least one type of interfering element is any one of Nd and Sm or Nd and Sm and in a situation where the analysis element is Se, the at least one type of interfering element is any one of Gd and Dy or Gd and Dy.

According to another embodiment, the at least one type of interfering element is selected from Nd, Sm, Gd, and Dy.

According to another embodiment, the step of calculating the interference amount and the step of seeking the corrected value are carried out by a computing device external to the mass spectrometer.

According to another embodiment, the step of calculating the interference amount and the step of seeking the corrected value are carried out by a data processing means built into the mass spectrometer.

According to another embodiment, the mass spectrometer is an inductively coupled plasma mass spectrometer (ICP-MS), a microwave plasma mass spectrometer, or a glow-discharge mass spectrometer (GDMS).

According to another embodiment, a mass spectrometer is provided, wherein the mass spectrometer is an inductively coupled plasma mass spectrometer (ICP-MS), a microwave plasma mass spectrometer, or a glow-discharge mass spectrometer (GDMS), and the mass spectrometer carries out any of the methods disclosed herein.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

FIG. 1 is a list of isotope mass numbers, isotope abundance ratios, and divalent-ion mass-to-charge ratios for each of several rare-earth elements.

FIG. 4 provides an upper table that is a list of measurement values of ionic strength at respective mass-to-charge ratios of divalent ions of seven isotopes of Nd in a sample including Nd at a concentration of 1 ppm measured in two cell-gas modes (an $H_2$ mode and an He mode) by an existing ICP-MS, and a lower table that is a list of measurement values of ionic strength at the mass-to-charge ratio of 75 listed in the upper table in a situation of "no correction," corrected values thereof in a situation where "conventional correction" is performed, and corrected values thereof in a situation where "correction by present invention" is performed together with associated parameters.

FIG. 6 is a list of As spike recovery rates obtained for measurement values of when ionic strength at a mass-to-charge ratio of 75 is measured in two cell-gas modes (an $H_2$ mode and an He mode) by an existing ICP-MS in a situation of "no correction," in a situation where a correction by "conventional correction" is performed, and in a situation where "correction by present invention" is performed for a sample where As is present at 9.0 ppb together with sixteen types of rare-earth elements (REE) (La, Ce, Pr, Nd, Sm, Eu, Gd, Tb, Dy, Ho, Er, Tm, Yb, Lu, Y, and Sc), each at 1 ppm.

DETAILED DESCRIPTION

Figure 2:
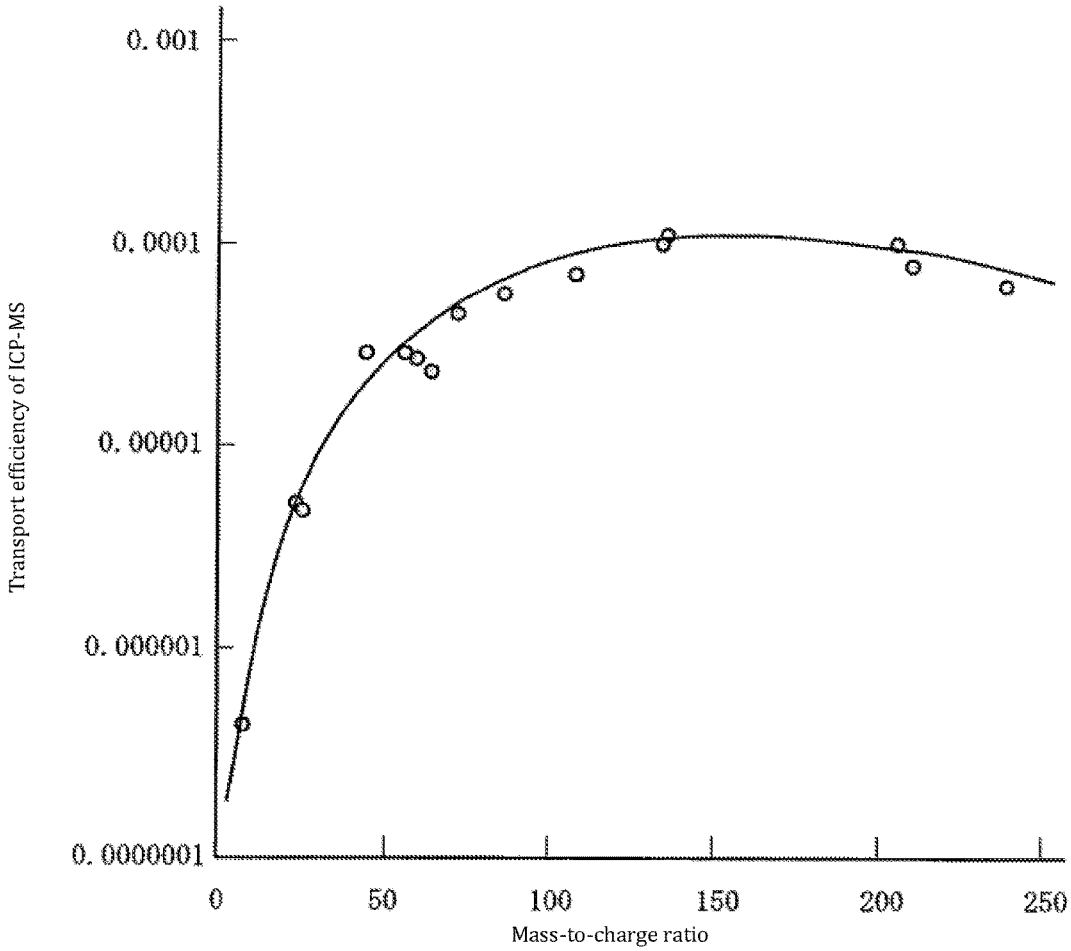
FIG. 2 is an illustration of one example of a relationship between ion mass-to-charge ratios and transport efficiencies in an existing ICP-MS.

The present invention further accounts for the bias effect of the mass spectrometer in the conventional correction method above. Specifically, a correction method of the present invention accounts for the mass-bias effect in the mass spectrometer by modifying [formula 1-1], which is the calculation formula of the conventional correction method above, using MB as a mass-bias correction coefficient as follows:

$$[\alpha_n]c=[\alpha_n]m-[X2_n/2]m\times A1/A2\times MB. \quad \text{[Formula 2]}$$

The mass-bias correction coefficient MB is sought using the measurement value of ionic strength $[X2_n/2]$m of the divalent ion of X2 and a measurement value of ionic strength $[X3_n/2]$m of a divalent ion of another isotope X3 having an odd mass number $X3_n$ that differs from that of X2; by using this to calculate [formula 2], correction of spectral interference is performed that also accounts for the mass-bias effect. In the present specification, $[X2_n/2]$m×A1/A2×MB in [formula 2] is referred to as an interference amount of spectral interference due to $X1^{2+}$ on the measurement ion of analysis element α. Note that the interference element that can be subjected to the correction method of the present invention is not limited to a rare-earth metal such as above. As is clear from the following description as well, an interfering element having at least three different isotopes where mass numbers of any two of the isotopes among these isotopes are odd and a mass-to-charge ratio of a divalent ion of another one isotope is identical to the mass-to-charge ratio of the measurement ion of the analysis element or so close to the mass-to-charge ratio of the measurement ion of the analysis element that separation is not possible by the mass spectrometer can also be the interfering element subjected to the correction method of the present invention. For example, when the analysis element is Mg (magnesium) of a mass number of 24, Ti (titanium) of a mass number of 48 can also be included as the interfering element subjected to the correction method of the present invention, and when the analysis element is Zn (zinc) of a mass number of 68, Ba (barium) of a mass number of 136 can also be included as the interfering element subjected to the correction method of the present invention. Here, a divalent ion of Ti of the mass number of 48 causes spectral interference for Mg of the mass number of 24, and isotopes of Ti include, in addition to an isotope where the mass number is 48, isotopes of mass numbers of 47 and 49—that is, two isotopes whose mass numbers are odd. Moreover, a divalent ion of Ba of the mass number of 136 causes spectral interference for Zn of the mass number of 68, and isotopes of Ba include, in addition to an isotope where the mass number is 136, isotopes of mass numbers of 135 and 137—that is, two isotopes whose mass numbers are odd.

The correction method of the present invention is described below. The analysis element in the measurement sample is defined as α. As above, when ionized, analysis element α becomes a monovalent ion. As such, the mass number $\alpha_n$ of the measurement isotope of analysis element α and the mass-to-charge ratio of the measurement ion of analysis element α are equal. The sample includes at least one type of interfering element (one type of interfering element among these being defined as β) where a divalent ion thereof causes spectral interference for the measurement ion of analysis element α. Three different isotopes of β are defined as β1, β2, and β3, and divalent ions of each of these isotopes are defined as $\beta1^{2+}$, $\beta2^{2+}$, and $\beta3^{2+}$. Mass numbers of β1 and β2 are both odd. $\beta3^{2+}$, the divalent ion of β3, causes spectral interference for the measurement ion of analysis element α because a mass-to-charge ratio thereof is identical to the mass-to-charge ratio $\alpha_n$ or so close to $\alpha_n$ that separation is not possible at the resolution of the mass spectrometer. Moreover, isotope abundance ratios of β1, β2, and β3 are respectively defined as A1, A2, and A3; mass-to-charge ratios of $\beta1^{2+}$, $\beta2^{2+}$, and $\beta3^{2+}$ are respectively defined as M1, M2, and M3; and measurement values of ionic strength of $\beta1^{2+}$ and $\beta2^{2+}$ measured by the mass spectrometer are respectively defined as C1 and C2. An ionic strength of $\beta3^{2+}$ is defined as C3; however, C3 is an unknown value due to the spectral interference on the measurement ion of analysis element α. Because the mass-to-charge ratios of $\beta1^{2+}$ and $\beta2^{2+}$, which are divalent ions of isotopes of odd mass numbers, are not integers, the ionic strengths of these divalent ions can be accurately measured without spectral interference by another ion (that is, both C 1 and C2 are values that can be accurately measured).

Here, it is known that a difference in the mass-bias effect between no fewer than two isotope ratios can be approximated by a coefficient of a difference in mass number between two isotopes (for example, see patent literature 2).

For example, defining a, b, and c as coefficients, expressions such as the following are possible:

$$C2/C1=A2/A1\times(1+a\times\Delta M21), \quad \text{[Formula 3]}$$

$$C2/C1=A2/A1\times(1+b)^{\Delta M21}, \quad \text{[Formula 4]}$$

$$C2/C1=A2/A1\times\exp(c\times\Delta M21). \quad \text{[Formula 5]}$$

Note that ΔM21=M2−M1.

Here, when the relationship of [formula 3] is also applied to the unknown value C3, by a definition where ΔM32=M3−M2, the following expression is possible:

$$C3/C2=A3/A2\times(1+a\times\Delta M32). \quad \text{[Formula 6]}$$

As such, $$C3=C2\times(A3/A2)\times(1+a\times\Delta M32). \quad \text{[Formula 7]}$$

Here, from [formula 3], $$a=(1/\Delta M21)\times[(C2/C1)/(A2/A1)-1]. \quad \text{[Formula 8]}$$

Because A1, A2, M1, and M2 are known and, as above, C1 and C2 can be accurately measured, a can be sought using [formula 8]. Therefore, the unknown value C3 can be sought using [formula 7] from A1, A2, A3, M1, M2, and M3, which are known values, and C1 and C2, which can be accurately measured.

The relationships of [formula 4] and [formula 5] are similar. That is, when the relationship of [formula 4] is applied to the unknown value C3, by the definition where ΔM32=M3−M2, the following expression is possible:

$$C3/C2=A3/A2\times(1+b)^{\Delta M32}. \quad \text{[Formula 9]}$$

As such, $$C3=C2\times(A3/A2)\times(1+b)^{\Delta M32}. \quad \text{[Formula 10]}$$

Here, from [formula 4], $$b=[(C2/C1)/(A2/A1)]^{1/\Delta M21}-1. \quad \text{[Formula 11]}$$

Moreover, when the relationship of [formula 5] is applied to the unknown value C3, by the definition where ΔM32=M3−M2, the following expression is possible:

$$C3/C2=A3/A2\times\exp(c\times\Delta M32). \quad \text{[Formula 12]}$$

As such, $$C3=C2\times(A3/A2)\times\exp(c\times\Delta M32). \quad \text{[Formula 13]}$$

Here, from [formula 5], $$c=(1/\Delta M21)\times\ln[(C2/C1)/(A2/A1)]. \quad \text{[Formula 14]}$$

As with a, b and c in [formula 4] and [formula 5] can be sought from A1, A2, M1, M2, C1, and C2. As such, as with C3 in [formula 7], C3 in [formula 10] and [formula 13] can be sought from A1, A2, A3, M1, M2, and M3, which are known values, and C1 and C2, which can be accurately measured.

From respective comparisons between [formula 2] on one hand and [formula 7], [formula 10], and [formula 13] on the other, $$(1+a\times\Delta M32), \quad \text{[Formula 15]}$$

$$(1+b)^{\Delta M32}, \quad \text{[Formula 16]}$$

$$\exp(c\times\Delta M32) \quad \text{[Formula 17]}$$

each represent the mass-bias correction coefficient MB and C3 represents the interference amount. Therefore, the mass-bias correction coefficient MB is obtained from the known values A1, A2, M1, M2, and M3 and the measurement values of ionic strength C1 and C2 measured by the mass spectrometer. The corrected value of the measurement value of ionic strength at the mass-to-charge ratio $\alpha_n$ (that is, the value corrected for spectral interference by accounting for the mass-bias effect), $[\alpha_n]c$, is obtained by subtracting C3 from the measurement value of ionic strength $[\alpha_n]m$ at the mass-to-charge ratio $\alpha_n$. In a situation where [formula 7] is used as the formula to seek C3, $[\alpha_n]c$ is obtained as follows:

$$[\alpha n]c=[\alpha n]m-C2\times(A3/A2)\times(1+a\times\Delta M32). \quad \text{[Formula 18]}$$

Here, a is given by [formula 8].

As such, a principal characteristic of the present invention is as follows: Because both divalent ions of two isotopes of an interfering element having odd mass numbers do not receive spectral interference due to another ion, ionic strengths of these divalent ions can be accurately measured. As such, a mass-bias correction coefficient MB can be more accurately calculated using measurement values of ionic strength of these divalent ions together with a known theoretical isotope ratio of the two isotopes and a difference in mass-to-charge ratios of the ions of the two isotopes. Focusing on this, by measuring the ionic strengths of these two divalent ions, an interference amount of spectral interference due to a divalent ion of the one other isotope of the interfering element on a measurement ion of an analysis element can be more accurately determined by also accounting for the mass-bias effect.

There is a situation where, in addition to element β, present in the sample is one more type of interfering element where a divalent ion thereof causes spectral interference for the measurement ion of analysis element α because a mass-to-charge ratio of this divalent ion of the interfering element is identical to the mass-to-charge ratio $\alpha_n$ or so close to $\alpha_n$ that separation is not possible at the resolution of the mass spectrometer and where two different isotopes of this interfering element have an odd mass number. In this situation, a correction of the spectral interference accounting for the mass-bias effect can be performed similarly to the above for this interfering element as well. For example, defining this one additional type of interfering element as γ, C3 is calculated in a similar manner by using measurement values of ionic strength of divalent ions of two different isotopes having odd mass numbers among isotopes of γ. By subtracting this C3 from $[\alpha_n]c$ in [formula 18], spectral interference due to two types of interfering elements, elements β and γ, can be corrected by accounting for the mass-bias effect.

Flow of Measurement of Ionic Strength and Correction Calculations

Figure 7:
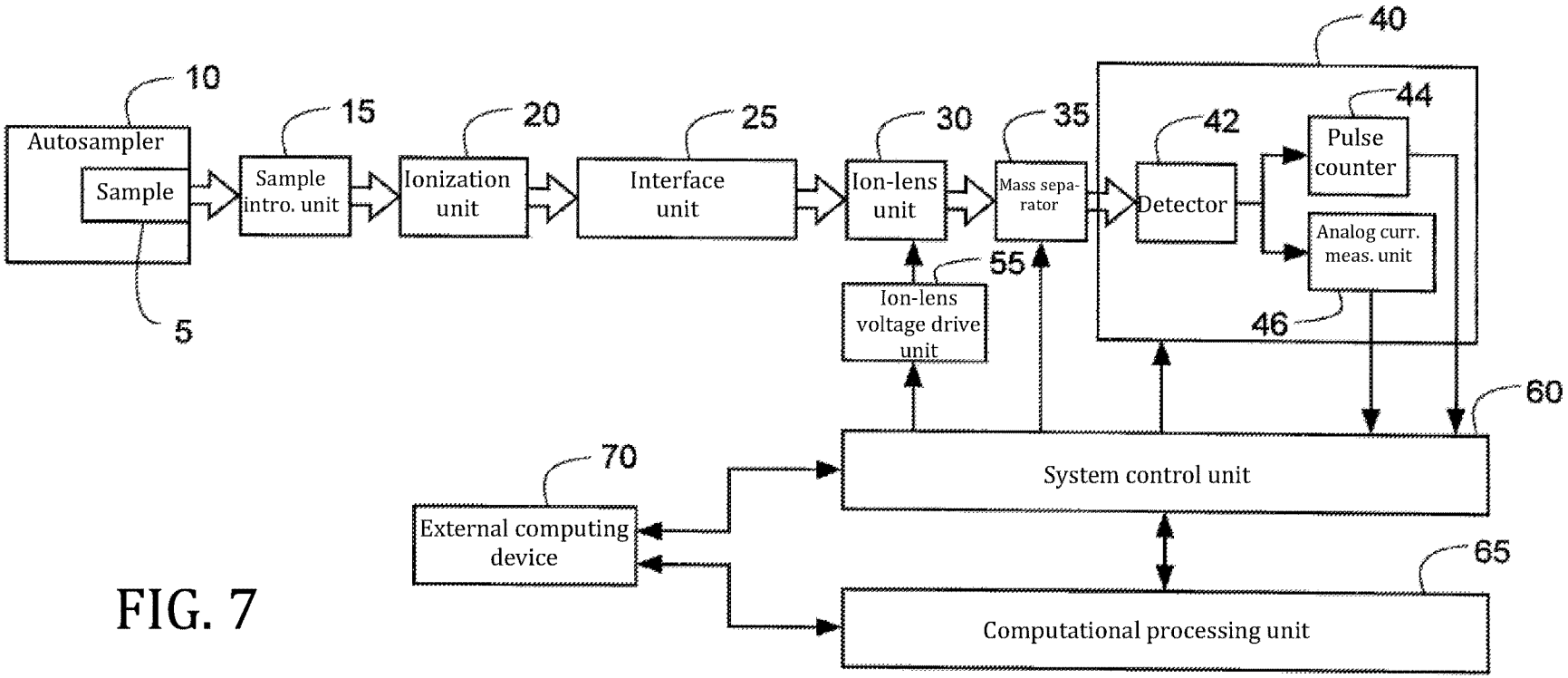
FIG. 7 is a block diagram of an existing inductively coupled plasma mass spectrometer (ICP-MS).

A flow of ionic strength measurement using an existing mass spectrometer (for example, the ICP-MS in FIG. 7) and correction calculations for seeking a corrected value of this measurement value according to a first embodiment of the present invention is described with reference to the flowchart in FIG. 3. Note that a type of interfering element whose spectral interference is to be corrected, a number of these interfering elements, and the divalent ion of this interfering element can be selected or determined in advance according to requirements such as the analysis element or a type of measurement sample. Note that here, it is assumed that the correction calculations (calculations at steps 330 and 340 below) are carried out by a computational processing unit built into the mass spectrometer (for example, the computational processing unit 65 in FIG. 7). However, these correction calculations can also be performed by an external computing device by transferring data measured by the mass spectrometer to a computing device external to the mass spectrometer (for example, the external computing device 70 in FIG. 7).

Hereinbelow, one such interfering element selected as target of correction for spectral interference on the measurement ion of analysis element α is defined as β, and three different isotopes of interfering element β present in the sample are defined as β1, β2, and β3. Mass numbers of β1, β2, and β3 are respectively defined as $\beta1_n$, $\beta2_n$, and $\beta3_n$, and divalent ions of β1, β2, and β3 are respectively defined as $\beta1^{2+}$, $\beta2^{2+}$, and $\beta3^{2+}$. In this situation, mass-to-charge ratios of $\beta1^{2+}$, $\beta2^{2+}$, and $\beta3^{2+}$ are respectively $\beta1_n/2$, $\beta2_n/2$, and $\beta3_n/2$. Moreover, the mass numbers $\beta1_n$ and $\beta2_n$ of β1 and β2 are both odd.

As above, analysis element α becomes a monovalent ion when ionized, and as such, the mass number $\alpha_n$ of the measurement isotope of analysis element α and the mass-to-charge ratio of the measurement ion of analysis element α are equal. $\beta3^{2+}$, the divalent ion of β3, causes spectral interference for the measurement ion of analysis element α because the mass-to-charge ratio $\beta3_n/2$ thereof is identical to the mass-to-charge ratio $\alpha_n$ or so close to $\alpha_n$ that separation is not possible at the resolution of the mass spectrometer. Note that the measurement value of ionic strength measured by the mass spectrometer is stored in a memory (for example, a memory, not illustrated, in the computational processing unit 65 in FIG. 7) of the mass spectrometer as, for example, an ion count per second (cps). Moreover, in a situation where the mass spectrometer is a quadrupole mass spectrometer, the mass resolution is set as described in relation to FIG. 7 by appropriately adjusting a DC voltage and a high-frequency AC voltage applied to rod electrodes configuring the mass spectrometer.

First, as above, to increase a measurement precision of ionic strength, at step 300, the mass resolution of the mass spectrometer is changed and set to a peak that is narrower than normal. In a situation where the mass spectrometer is a quadrupole spectrometer, the mass resolution is set to a value no greater than 0.4 amu (FWHM) (for example, 0.3 amu [FWHM]), which is greater than a value at a time of normal analysis of 0.5 to 0.8 amu (FWHM).

At the next step 310, the sample is introduced into the mass spectrometer. The ionic strength at the mass-to-charge ratio $\alpha_n$ is measured, and this measurement value $[\alpha_n]$m is stored in the memory.

Next, at step 320, the ionic strength at the mass-to-charge ratio $\beta1_n/2$ of $\beta1^{2+}$ in the sample is measured, and this measurement value $[\beta1_n/2]$m is stored in the memory. Moreover, the ionic strength at the mass-to-charge ratio $\beta2_n/2$ of $\beta2^{2+}$ in the sample is measured, and this measurement value $[\beta2_n/2]$m is stored in the memory. Here, in a situation where an interfering element other than element β (this element being defined as γ) is selected as the interfering element whose spectral interference is to be corrected, the ionic strengths at the mass-to-charge ratios of respective divalent ions of two different isotopes are similarly measured. In this situation, like element β, element γ has three different isotopes γ1, γ2, and γ3 where γ1 and γ2 both have an odd mass number (these being respectively $\gamma1_n$ and $\gamma2_n$). As with β, ionic strengths at mass-to-charge ratios $\gamma1_n/2$ and $\gamma2_n/2$ of $\gamma1^{2+}$ and $\gamma2^{2+}$, which are respective divalent ions of γ1 and γ2, are measured, and respective measurement values $[\gamma1_n/2]$m and $[\gamma2_n/2]$m are stored in the memory. When measurement of ionic strength at the mass-to-charge ratios of each divalent ion for all types of interfering elements selected to be the target of correction for spectral interference and storage of the measurement values in the memory are ended, the flow proceeds to step 330.

At step 330, $[\beta1_n/2]$m and $[\beta2_n/2]$m obtained at step 320 are used to seek the interference amount C3 due to $\beta3^{2+}$. In a situation where [formula 7] is used as the formula for seeking C3, $[\beta1_n/2]$m and $[\beta2_n/2]$m are respectively substituted into C1 and C2 in [formula 7] and [formula 8] above; respective isotope abundance ratios of β1, β2, and β3 are substituted into A1, A2, and A3; and mass-to-charge ratios of respective divalent ions of β1, β2, and β3 are substituted into M1, M2, and M3 to calculate the interference amount C3 due to $\beta3^{2+}$. At step 320, with interfering elements other than β as well, as with β, in a situation where ionic strengths of divalent ions of two different isotopes having odd mass numbers are measured, the interference amount C3 is similarly calculated for this interfering element as well. Instead of [formula 7], [formula 10] or [formula 13] can be used to similarly seek the interference amount C3.

Next, at step 340, the corrected value [a]c of the measurement value $[\alpha_n]$m is sought by sequentially subtracting the interference amounts C3 obtained at step 330 for each interfering element from the measurement value of ionic strength $[\alpha_n]$m at the mass-to-charge ratio $\alpha_n$ obtained at step 310. In a situation where two types of interfering elements are selected as targets of correction for spectral interference, defining the interference amounts obtained for each interfering element as $C3_1$ and $C3_2$, $$[\alpha_n]c=[\alpha_n]m-(C3_1+C3_2).$$

The corrected value $[\alpha_n]$c is a value where spectral interference due to all interfering elements selected to be the target of correction for spectral interference is corrected by accounting for the mass-bias effect of the mass spectrometer. Afterward, using the value of $[\alpha_n]$c, conversion into a concentration is performed based on a separately measured calibration curve.

Specific Examples of Measurement and Calculation

Figure 3:
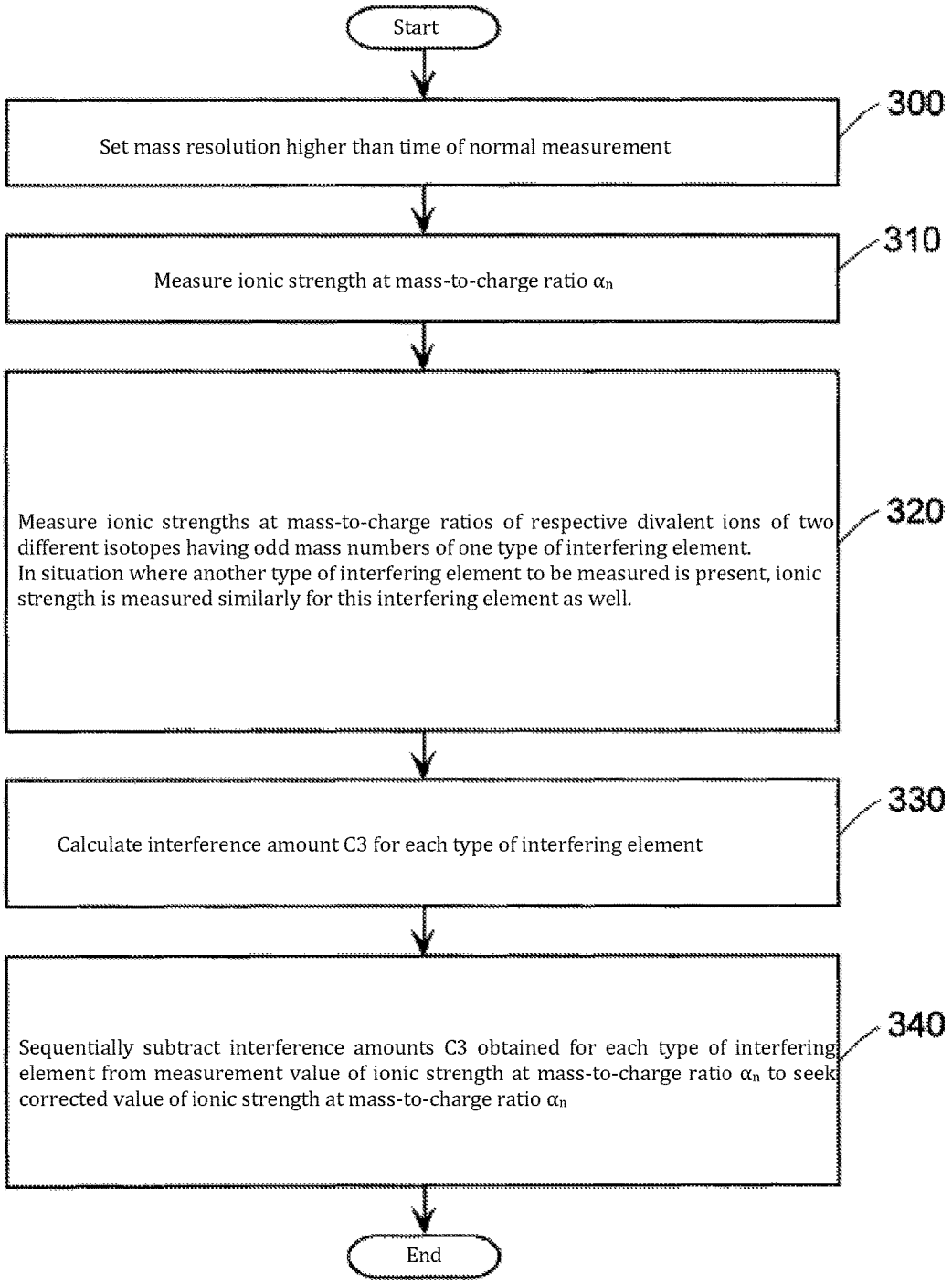
FIG. 3 is a flowchart illustrating a flow of measuring ionic strength and correction calculation using an existing mass spectrometer according to a first embodiment of the present invention.

Next, described according to the flow of FIG. 3 is a flow of measurement and correction calculations in a situation where, when interfering elements Nd and Sm are present together with analysis element As (mass number 75) in a sample, Nd and Sm are selected as interfering elements to be targets of correction for spectral interference. Here, spectral interference due to $^{150}Nd^{2+}$ on an $^{75}As$ ion of a mass-to-charge ratio of 75 is corrected using measurement values of ionic strength at mass-to-charge ratios of 72.5 and 71.5 (that is, measurement values of ionic strength of respective divalent ions $^{145}Nd^{2+}$ and $^{143}Nd^{2+}$ of $^{145}Nd$ and $^{143}Nd$, two isotopes of $^{150}Nd$), and spectral interference due to $^{150}Sm^{2+}$ on the $^{75}As$ ion of the mass-to-charge ratio of 75 is corrected, similarly to the correction for $^{150}Nd^{2+}$, using measurement values of ionic strength at mass-to-charge ratios of 73.5 and 74.5 (that is, measurement values of ionic strength of respective divalent ions $^{147}Sm^{2+}$ and $^{149}Sm^{2+}$ of $^{147}Sm$ and $^{149}Sm$, two isotopes of $^{150}Sm$).

First, at step 300, the mass resolution of the mass spectrometer is set to a peak that is narrower than normal—for example, 0.3 amu (FWHM).

At the next step 310, a measurement value of ionic strength [75]m at the mass-to-charge ratio of 75 is measured for the sample introduced into the mass spectrometer, and this measurement value [75]m is stored in the memory.

At the next step 320, the ionic strength at the mass-to-charge ratio of 71.5 (that is, the ionic strength of the divalent ion $^{143}Nd^{2+}$ of the isotope $^{143}Nd$ of $^{150}Nd$) is measured and this measurement value [71.5]m is stored in the memory. Moreover, the ionic strength at the mass-to-charge ratio of 72.5 (that is, the ionic strength of the divalent ion $^{145}Nd^{2+}$ of the other isotope, $^{145}Nd$) is measured and this measurement value [72.5] is stored in the memory. In the present example, because Sm is also selected as an interfering element that is a target of correction for spectral interference, the ionic strengths at the mass-to-charge ratios of 73.5 and 74.5 (that is, the ionic strengths of $^{147}Sm^{2+}$ and $^{149}Sm^{2+}$) are measured similarly and these measurement values [73.5]m and [74.5]m are stored in the memory.

At the next step 330, the measurement values stored in the memory at step 320 are read and, using these measurement values, respective interference amounts C3 due to $^{150}Nd^{2+}$ and $^{150}Sm^{2+}$ are respectively sought. In a situation where [formula 7] is used as the formula for seeking C3, the measurement values [71.5]m and [72.5]m and the isotope abundance ratios of $^{143}Nd$, $^{145}Nd$, and $^{150}Nd$ are respectively substituted into C1, C2, A1, A2, and A3 in [formula 7] or [formula 8] and the mass-to-charge ratios of $^{143}Nd^{2+}$, $^{145}Nd^{2+}$, and $^{150}Nd^{2+}$ are respectively substituted into M1, M2, and M3 in [formula 7] or [formula 8] to seek the interference amount C3 due to $^{150}Nd^{2+}$. Similarly, the measurement values [73.5]m and [74.5]m and the isotope abundance ratios of $^{147}Sm$, $^{149}Sm$, and $^{150}Sm$ are respectively substituted into C1, C2, A1, A2, and A3 of [formula 7] or [formula 8] and the mass-to-charge ratios of $^{147}Sm^{2+}$, $^{149}Sm^{2+}$, and $^{150}Sm^{2+}$ are respectively substituted into M1, M2, and M3 of [formula 7] or [formula 8] to seek the interference amount C3 due to $^{150}Sm^{2+}$. [Formula 10] or [formula 13] can also be used instead of [formula 7] to likewise seek the respective interference amounts C3 due to $^{150}Nd^{2+}$ and $^{150}Sm^{2+}$.

At the next step 340, [75]m stored in the memory at step 310 is read. By subtracting the interference amount C3 due to $^{150}Nd^{2+}$ and the interference amount C3 due to $^{150}Sm^{2+}$ obtained at step 330 from this [75]m, a corrected value of ionic strength of [75]c at the mass-to-charge ratio of the measurement ion of analysis element As is obtained where spectral interference due to both $^{150}Nd^{2+}$ and $^{150}Sm^{2+}$ on the $^{75}As$ ion of the mass-to-charge ratio of 75 is corrected.

Example of Measurement and Correction Result

One example of a correction result of when the correction method of the present invention using [formula 7] as the formula for seeking the interference amount C3 is applied to a measurement value obtained by measuring ionic strength using an existing mass spectrometer according to the first embodiment of the present invention is illustrated in FIG. 4. The upper table in FIG. 4 lists measurement values of ionic strength (cps) at respective mass-to-charge ratios of divalent ions of seven isotopes of Nd obtained by measuring an Nd matrix of a concentration of 1 ppm (As not being included in this matrix) in two measurement modes of an $H_2$ mode and an He mode by an existing ICP-MS.

The lower table in FIG. 4 respectively lists the mass-to-charge ratios of 71.5, 72.5, and 75 in the upper table in FIG. 4 (mass-to-charge ratios of $^{143}Nd^{2+}$, $^{145}Nd^{2+}$, and $^{150}Nd^{2+}$) as values of M1, M2, and M3 and respectively lists the isotope abundance ratios of $^{143}Nd$, $^{145}Nd$, and $^{150}Nd$ as values of A1, A2, and A3. In the diagram, ΔM21 is M2−M1 and ΔM32 is M3−M2. Moreover, the measurement values of ionic strength (cps) at the mass-to-charge ratios of 71.5 and 72.5 in the upper table of FIG. 4 are respectively listed as values of C1 and C2, and a mass-bias correction coefficient calculated by [formula 8] and [formula 15] is listed as the value of MB.

The last three lines in the lower table in FIG. 4 respectively list measurement values of ionic strength (in an $H_2$ mode and an He mode) at the mass-to-charge ratio of 75 listed in the upper table in FIG. 4 in a situation of "no correction" (that is, a situation where spectral interference is not corrected), corrected values thereof in a situation where "conventional correction" is performed (that is, a situation where spectral interference due to $^{150}Nd^{2+}$ is corrected by the conventional correction method above), and corrected values thereof in a situation where "correction by present invention" is performed (here, a situation where spectral interference due to $^{150}Nd^{2+}$ is corrected by the correction method of the present invention using [formula 7] as the formula for seeking the interference amount C3). As indicated in the "No correction" row in the lower table of FIG. 4, in a situation where spectral interference due to $^{150}Nd^{2+}$ on the mass-to-charge ratio of 75 is not corrected by the conventional correction method or the correction method of the present invention, the Nd at 1 ppm generates 8,127 cps in the $H_2$ mode and 28,143 cps in the He mode as the measurement values of ionic strength at the mass-to-charge ratio of 75.

Here, with this matrix where As is not included and only $^{150}Nd^{2+}$ is present as the ion of the mass-to-charge ratio of 75, in a situation where an interference amount due to $^{150}Nd^{2+}$ on the measurement ion of the analysis element of the mass-to-charge ratio of 75 that is not present in this matrix is ideally corrected, the corrected value of ionic strength at the mass-to-charge ratio of 75 is theoretically zero due to the actual measurement value of ionic strength of $^{150}Nd^{2+}$ and the interference amount due to this cancelling each other out. However, in a situation where the conventional correction method above is applied, as indicated in the "Conventional correction" row, the corrected value of ionic strength at the mass-to-charge ratio of 75 is considerably less than the value in the situation of "no correction." However, comparatively large values of 1,082 cps ($H_2$ mode) and 3,248 cps (He mode) are still generated. This is mainly due to the conventional correction method not accounting for a shift from the theoretical value of $^{150}Nd/^{145}Nd$ due to the mass-bias effect.

In contrast, in a situation where the correction method of the present invention is applied, as indicated in the "Correction by present invention" row, in the $H_2$ mode and the He mode respectively, the corrected values of ionic strength at the mass-to-charge ratio of 75 are 318 cps and 498 cps (both being absolute values). These are very small values compared to the situation where the conventional correction method is applied (values closer to the ideal value of zero); it is understood that very favorable corrected values are obtained. This is a result of the correction method of the present invention performing correction that accounts for the mass-bias effect in calculating the interference amount due to $^{150}Nd^{2+}$.

Figure 5:
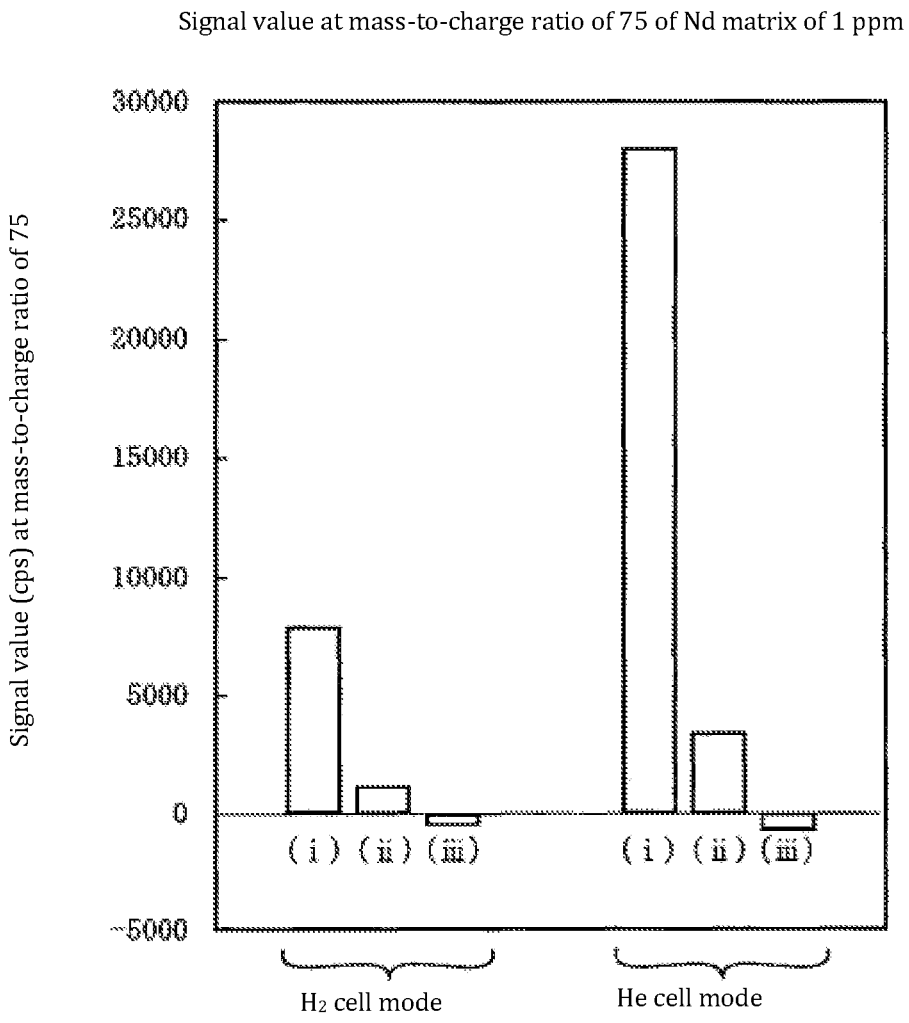
FIG. 5 is a diagram where the measurement values described in FIG. 4 in the situation of "no correction," the corrected values thereof in the situation where "conventional correction" is performed, and the corrected values thereof in the situation where "correction by present invention" is performed are graphed for the $H_2$ mode and the He mode.

(i), (ii), and (iii) in FIG. 5 are diagrams respectively graphing, for the $H_2$ mode and the He mode, the measurement value of ionic strength (cps) in the situation of "no correction" in FIG. 4, the corrected value (cps) of this measurement value in the situation where "conventional correction" is performed, and the corrected value (cps) of this measurement value in the situation where "correction by the present invention" is performed.

FIG. 6 respectively lists, for a sample where As at 9.0 ppb is present together with sixteen types of rare-earth elements (REE) at 1 ppm each (La, Ce, Pr, Nd, Sm, Eu, Gd, Tb, Dy, Ho, Er, Tm, Yb, Lu, Y, and Sc), As spike recovery rates obtained in a situation where "no correction" is performed for a measurement value of when ionic strength is measured in two cell-gas modes ($H_2$ mode and He mode) by an existing ICP-MS (that is, a situation where no correction for spectral interference is performed), a situation where correction by "conventional correction" is performed (that is, a situation where spectral interference due to $^{150}Nd^{2+}$ and $^{150}Sm^{2+}$ is corrected by the conventional correction method above), and a situation where "correction by the present invention" is performed (here, a situation where spectral interference due to $^{150}Nd^{2+}$ and $^{150}Sm^{2+}$ is corrected by the correction method of the present invention using [formula 7] as the formula to seek the interference amount C3). As illustrated in FIG. 6, in the situation where the correction method of the present invention is applied, a much more favorable spike recovery rate of As (that is, closer to 100%) is obtained than in the situation where the conventional correction method is applied, let alone the situation where neither the conventional correction method nor the correction method of the present invention is applied.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method of correcting spectral interference due to a divalent ion of an interfering element on a measurement ion of an analysis element in a sample measured by a mass spectrometer using a plasma ion source, where at least one type of interfering element having three different isotopes is present in the sample, the three different isotopes being a first isotope having an odd mass number, a second isotope having an odd mass number, and a third isotope, the method comprising:

using, from the at least one type of interfering element, a measurement value of ionic strength of a divalent ion of the first isotope in the sample and a measurement value of ionic strength of a divalent ion of the second isotope in the sample to calculate an interference amount of spectral interference due to a divalent ion of the third isotope on the measurement ion of the analysis element; and subtracting the interference amount calculated for the at least one type of interfering element from a measurement value of ionic strength at a mass-to-charge ratio of the measurement ion of the analysis element in the sample measured by the mass spectrometer to seek a corrected value of ionic strength at the mass-to-charge ratio of the measurement ion of the analysis element.

2. The method of claim 1, wherein when, for each of the at least one type of interfering element, the measurement value of ionic strength of the divalent ion of the first isotope and the measurement value of ionic strength of the divalent ion of the second isotope are respectively defined as C1 and C2; isotope abundance ratios of the first isotope, the second isotope, and the third isotope are respectively defined as A1, A2, and A3; and mass-to-charge ratios of the divalent ion of the first isotope, the divalent ion of the second isotope, and the divalent ion of the third isotope are respectively defined as M1, M2, and M3, the interference amount of spectral interference due the divalent ion of the third isotope of each of the at least one type of interfering element is calculated as $$C2\times(A3/A2)\times[(1+a\times(M3-M2)],$$

where a=[1/(M2−M1)]×[(C2/C1)/(A2/A1)−1].

3. The method of claim 1, wherein the mass spectrometer comprises a quadrupole mass spectrometer, and a mass resolution of the mass spectrometer is set to no greater than 0.4 amu (FWHM).

4. The method of claim 1, wherein the analysis element is As or Se.

5. The method of claim 1, wherein the analysis element and the at least one type of interfering element are selected from the group consisting of:

the analysis element is As, and the at least one type of interfering element is any one of Nd and Sm or Nd and Sm; and the analysis element is Se, and the at least one type of interfering element is any one of Gd and Dy or Gd and Dy.

6. The method of claim 1, wherein the at least one type of interfering element is selected from Nd, Sm, Gd, and Dy.

7. The method of claim 1, wherein the calculating of the interference amount and the seeking of the corrected value are carried out by a computing device external to the mass spectrometer.

8. The method of claim 1, wherein the calculating of the interference amount and the seeking of the corrected value are carried out by a data processing means built into the mass spectrometer.

9. The method of claim 1, wherein the mass spectrometer is an inductively coupled plasma mass spectrometer (ICP-MS), a microwave plasma mass spectrometer, or a glow-discharge mass spectrometer (GDMS).

10. A mass spectrometer, wherein the mass spectrometer is an inductively coupled plasma mass spectrometer (ICP-MS), a microwave plasma mass spectrometer, or a glow-discharge mass spectrometer (GDMS), and the mass spectrometer is configured for carrying out the method of claim 1.

* * * * *